US007377051B2

(12) United States Patent
Morris et al.

(10) Patent No.: US 7,377,051 B2
(45) Date of Patent: May 27, 2008

(54) COILED TUBING COUNTER

(75) Inventors: Collin Rickey Morris, Lloydminster (CA); Joseph Henry Reck, Lloydminster (CA); Douglas Glen Boyd, Lloydminster (CA); Shawn Rodney Van Drecht, Lloydminster (CA)

(73) Assignee: Count-Rite Oilfield Solutions Inc., Lloydminster, CA (US)

( * ) Notice: Subject to any disclaimer, the term of this patent is extended or adjusted under 35 U.S.C. 154(b) by 101 days.

(21) Appl. No.: 11/345,299

(22) Filed: Feb. 2, 2006

(65) Prior Publication Data

US 2006/0248743 A1 Nov. 9, 2006

(30) Foreign Application Priority Data

May 6, 2005 (CA) ..... 2506446

(51) Int. Cl.
*G01B 3/12* (2006.01)

(52) U.S. Cl. ..... 33/772; 33/734; 33/736

(58) Field of Classification Search ..... 33/772, 33/736, 787, 544, 773–778, 734; 166/64
See application file for complete search history.

(56) References Cited

U.S. PATENT DOCUMENTS 1,006,473 A * 10/1911 Frank ..... 33/747
1,969,969 A * 8/1934 Dunagin ..... 33/749
2,221,767 A * 11/1940 Hayward et al. ..... 33/736
2,591,615 A * 4/1952 Saff et al. ..... 33/744
2,806,372 A * 9/1957 Arps ..... 73/152.44
3,688,410 A * 9/1972 Zeidler et al. ..... 33/773
3,771,228 A * 11/1973 Culver ..... 33/772
3,972,124 A * 8/1976 Mikolajczyk ..... 33/734
4,205,447 A 6/1980 Smith
4,457,071 A 7/1984 Alphonso
4,481,714 A 11/1984 Nelson
4,570,348 A * 2/1986 Amsler et al. ..... 33/734
4,577,410 A 3/1986 Ritter
4,621,403 A * 11/1986 Babb et al. ..... 29/433
5,205,048 A * 4/1993 Toomey et al. ..... 33/544
2007/0227744 A1* 10/2007 Rodgers ..... 166/380

* cited by examiner

*Primary Examiner*—G. Bradley Bennett
*Assistant Examiner*—Tania C Courson
(74) *Attorney, Agent, or Firm*—Ryan W. Dupuis; Adrian D. Battison; Michael R. Williams

(57) ABSTRACT

A tubing counter for counting coiled tubing inserted into a well includes an outer housing having a through passage for receiving the coiled tubing therethrough. In some embodiments, pressure rated connectors at both of the ends of the outer housing sealably connect the outer housing in series between the coiled tubing injector head and the outer casing of the well. A plurality of counting wheels are rotatably supported within the outer housing for rolling engagement along coiled tubing inserted through the outer housing while a counting mechanism records a number of rotations of each counting wheel independently of the other wheels to minimize counting errors. Locating the counter below the injector head and below the tubing stripper ensures that the tubing is cleaner and less likely to slip in contact with the counting wheels while also accounting for stretching of the tubing for more accurate measurement.

19 Claims, 5 Drawing Sheets

COILED TUBING COUNTER

This application claims foreign priority benefits from Canadian Patent Application 2,506,446 filed May 6, 2005.

FIELD OF THE INVENTION

The present invention relates to a counter for counting coiled tubing, and more particularly relates to a counter for counting the coiled tubing as it is inserted into an oil or gas well.

BACKGROUND

In the field of oil and gas production various activities related to wells involve the insertion of coiled tubing into the wells. Coiled tubing is typically dispended from a roll supported on a rig which inserts the tubing into the casing of the well by a coiled tubing injector head supported above the casing. When inserting the tubing, it is desirable to count the length of tubing being inserted so as to know the depth of insertion of the bottom end of the tubing.

Various types of counters are known for strand material, including cable or tubing and the like. Typical counters make use of wheels which roll along the strand material as it is dispensed. Examples of counters are found in U.S. Pat. No. 4,457,071 to Alphonso, U.S. Pat. No. 4,205,447 to Smith, U.S. Pat. No. 4,577,410 to Ritter and U.S. Pat. No. 4,481,714 to Nelson. Known systems which are suited for coiled tubing, are generally required to be installed in conjunction with the injector head or be positioned thereabove.

When counters are connected above the injector head, the counters are prone to errors due slippage on the tubing which is dirty and exposed to the environment. These counters are therefore typically unable to account for the errors due to slippage between the counting wheel and the tubing upon which the counting wheel is riding. Also, these counters are simply transported on the exterior of trucks in a manner such that they are exposed to various abuse during use and transport. Furthermore, positioning of the counter above the injector head does not take into consideration how much the tubing stretches and accordingly these types of counters are also inaccurate in addition to requiring considerable maintenance.

Counters which are supported in conjunction with the injector head typically rely on a mechanical connection to the components of the injector head which may be subject to failure due to the complexity of the mechanisms required. These types of counters are also unable to accommodate for stretch of the tubing suspended below the injector head and accordingly are also inaccurate.

SUMMARY OF THE INVENTION

According to one aspect of the invention there is provided a tubing counter for counting coiled tubing inserted into a well having an outer casing and a coiled tubing injector head connected above the outer casing, the counter comprising:

an outer housing having a through passage extending between ends of the housing for receiving the coiled tubing therethrough;

pressure rated connectors at both of the ends of the outer housing for sealably connecting the outer housing in series between the coiled tubing injector head and the outer casing of the well;

at least one counting wheel rotatably supported within the outer housing for rolling engagement along coiled tubing inserted through the outer housing; and a counting mechanism for recording a number of rotations of said at least one counting wheel.

Use of a housing which can be connected with pressure rated connectors permits installation of the counter in series between the outer casing of the well and the injector head. The resulting counter provides a simple mechanism which is independent of the mechanisms of the injector head and which is protected within an enclosed housing. Locating the counter below the injector head and below the tubing stripper ensures that the tubing is cleaner and less likely to slip in contact with the counting wheels. Furthermore, location of the counter below the injector head accounts for stretching of the tubing for more accurate measurement of depth.

According to a further aspect of the present invention there is provided a tubing counter for counting coiled tubing inserted into a well having an outer casing and a coiled tubing injector head connected above the outer casing, the counter comprising:

an outer housing having a through passage extending between ends of the housing for receiving the coiled tubing therethrough;

connectors on the outer housing for connecting the outer housing in series with the coiled tubing injector head;

a plurality of counting wheels rotatably supported within the outer housing for rolling engagement along coiled tubing inserted through the outer housing; and a counting mechanism for recording a number of rotations of each counting wheel independently of the other wheels.

Use of a plurality of counting wheels which independently record a number of rotations ensures that any slippage errors can be readily identified regardless of whether the counter is positioned above or below the injector head.

In preferred embodiments, the pressure rated connectors are preferably arranged for connection of the outer housing below the tubing stripper and below the BOP of the well.

The counting mechanism preferably includes a plurality of markers spaced circumferentially about each wheel and a sensor associated with each wheel which senses and records the markers being rotated past the sensor.

Preferably each wheel has a generally cylindrical outer surface for engaging the tubing in which the outer surface has a substantially constant outer diameter. The outer surface may include a gripping texture thereon.

There may be provided an upper funnel structure at one end of the outer housing and a lower funnel structure at the other end of the housing for guiding the tubing into and out of the outer housing respectively. Each funnel structure preferably includes an annular bushing for slidably receiving the tubing therethrough.

The plurality of counting wheels are preferably supported on opposing sides of the through passage in the housing for engaging opposing sides of the tubing. At least one counting wheel on one side of the through passage is preferably biased towards at least one counting wheel on the other side of the through passage.

Preferably the outer housing is pressure rated and receives an inner housing therein in which the inner housing rotatably supports the counting wheels thereon. The inner housing may be selectively supported within the outer housing by support members spanning generally radially between the inner housing and the outer housing at opposed ends of the outer housing.

There may be provided a pressure rated port in the outer housing receiving electrical connections therethrough. An epoxy material may surround the electrical connections in the pressure rated port.

According to a further aspect of the present invention there is provided a method of counting coiled tubing inserted into a well having an outer casing and a coiled tubing injector head connected above the outer casing, the method comprising:

providing a tubing counter comprising an outer housing having a through passage extending between ends of the housing and at least one counting wheel rotatably supported within the outer housing;

connecting the ends of the outer housing of the counter in series between the coiled tubing injector head and the outer casing of the well;

inserting the coiled tubing through the outer housing of the counter in rolling contact with said at least one counting wheel; and counting a number of rotations of said at least one counting wheel.

The outer housing may be connected below the tubing stripper and the BOP of the well in one embodiment, or above the injector head in a further embodiment.

The method may include counting a number of rotations of each wheel independently of the other wheels and calculating an average number of rotations of the wheels.

The method may further include comparing the number of rotations of the wheels to one another and removing from the average, the number of rotations of any wheel which differs substantially from the other wheels.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
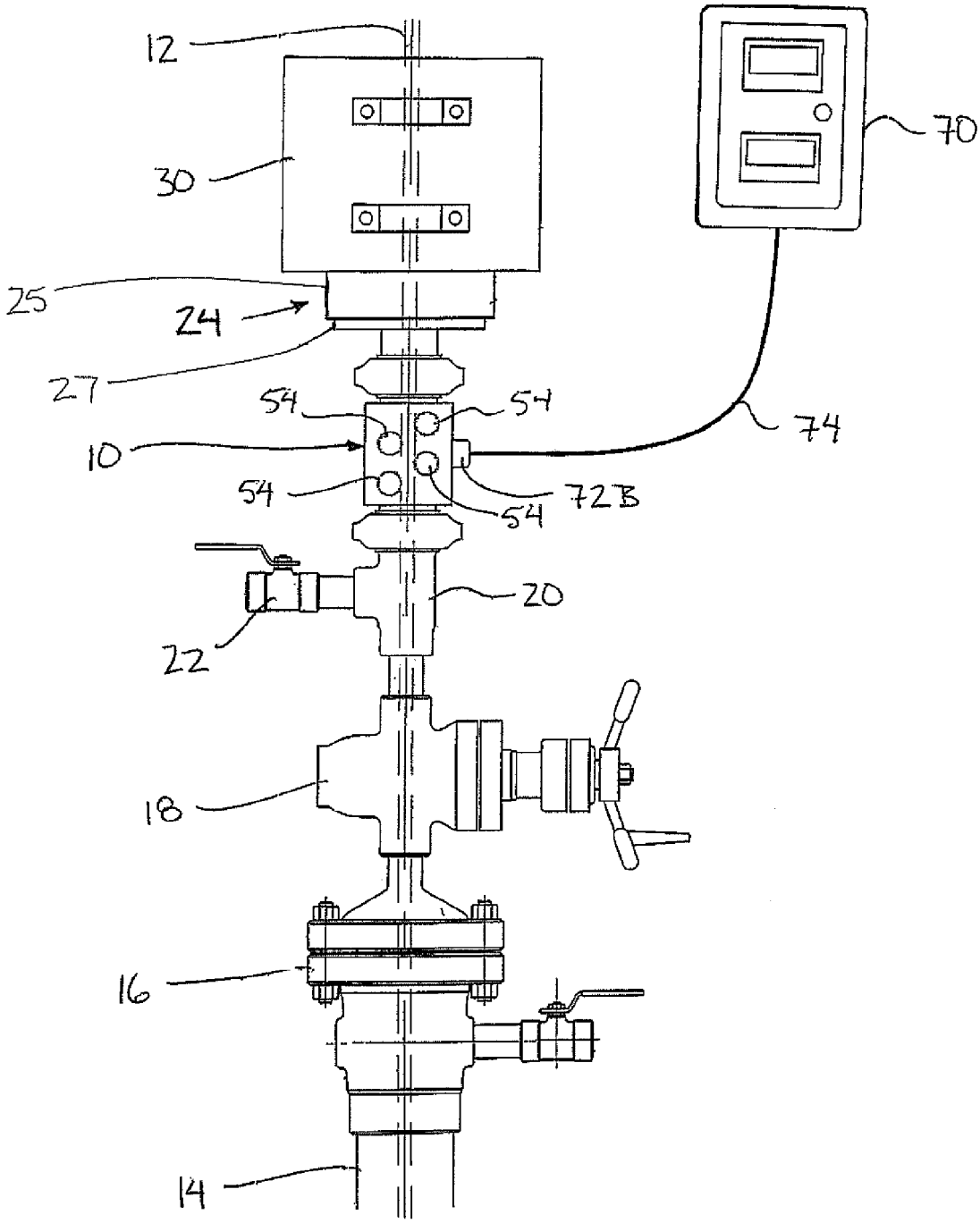
FIG. 1 is a side elevational view of the counter installed between the outer casing of the well and the coiled tubing injector head of the wellhead.
Figure 2:
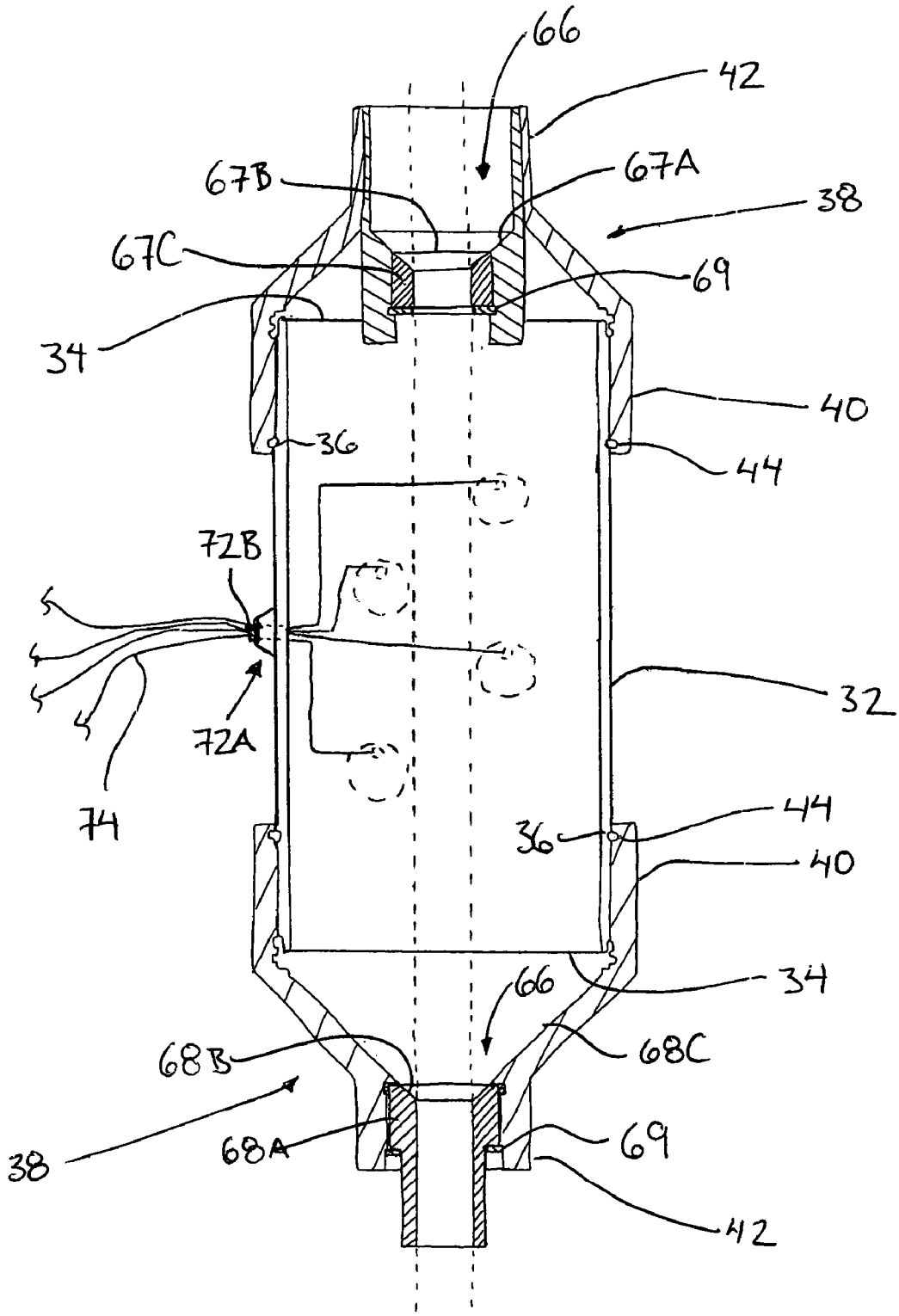
FIG. 2 is a partly sectional side elevational view of the outer housing of the counter.
Figure 4:
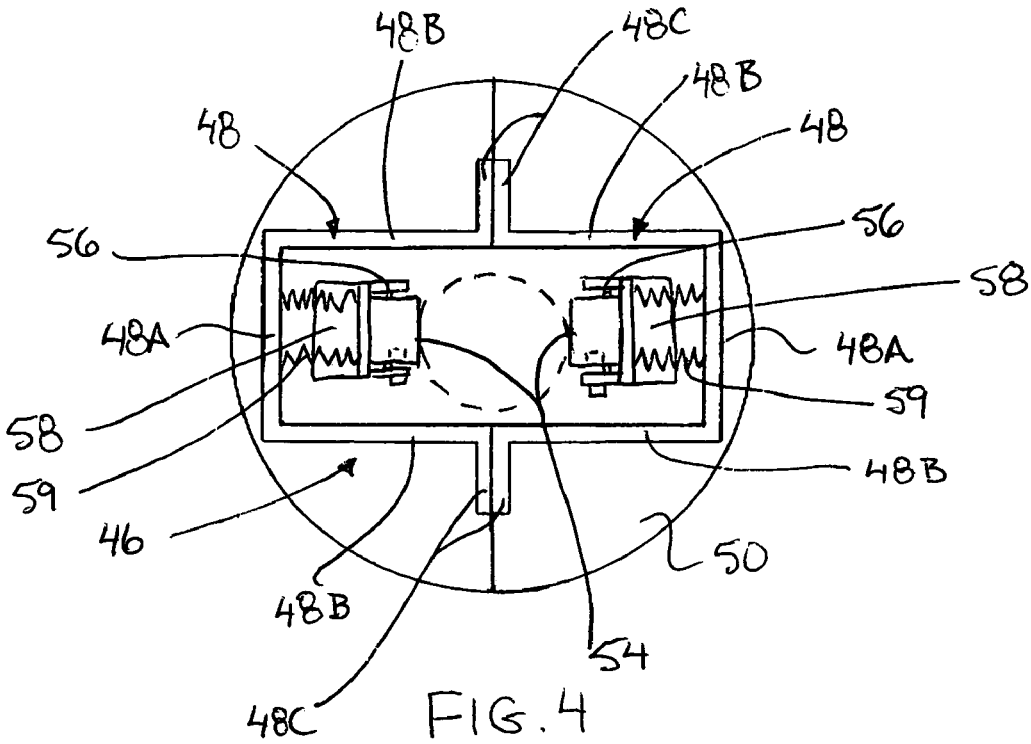
FIG. 4 is a top plan view of the inner housing of the housing.
Figure 3:
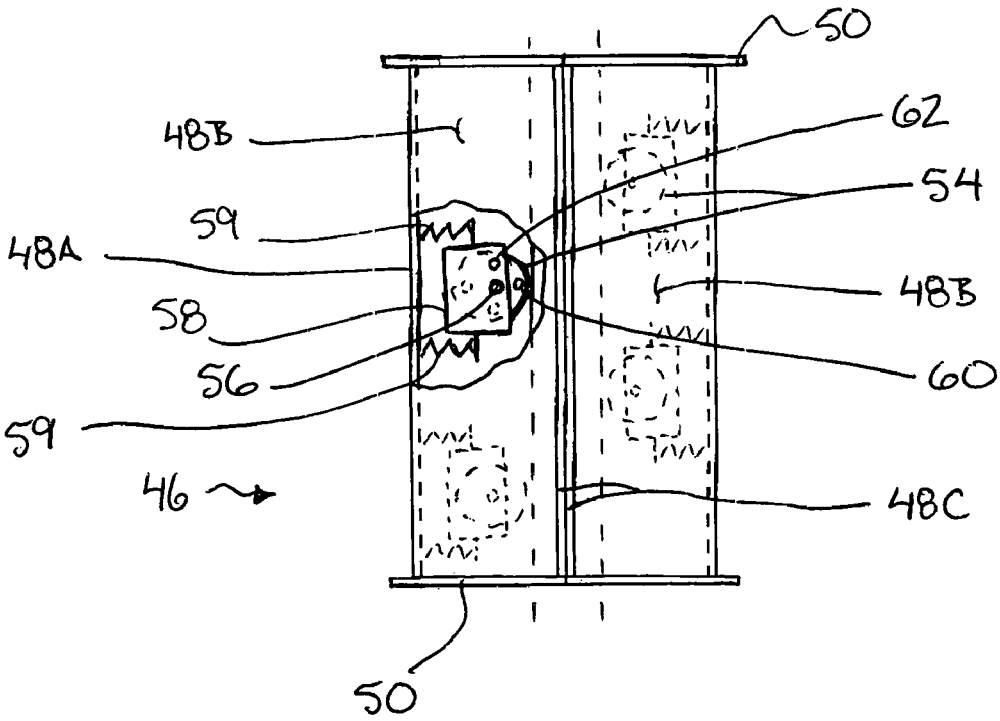
FIG. 3 is a partly sectional side elevational view of the inner housing of the counter.
Figure 5:
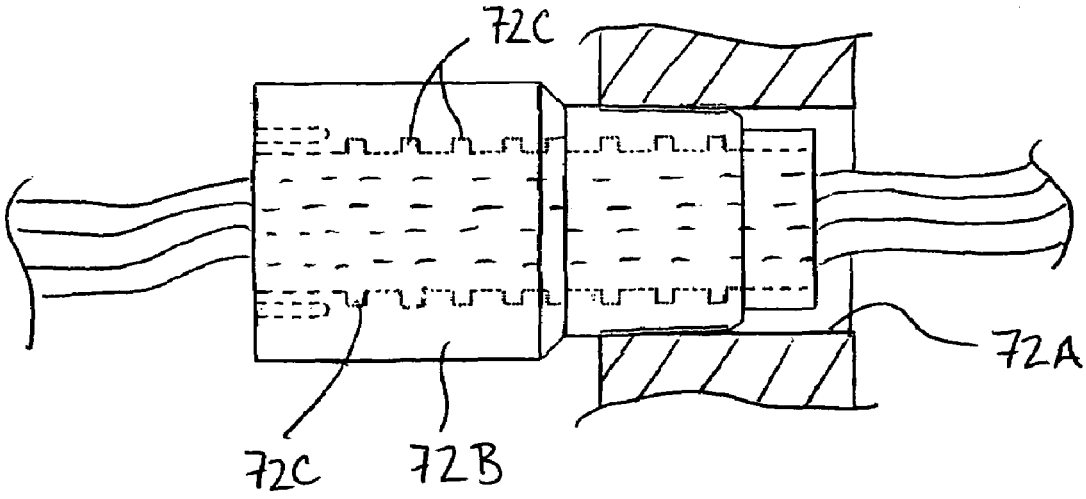
FIG. 5 is a side elevational view of a pressure rated plug for receiving electrical connectors through the housing.
Figure 6:
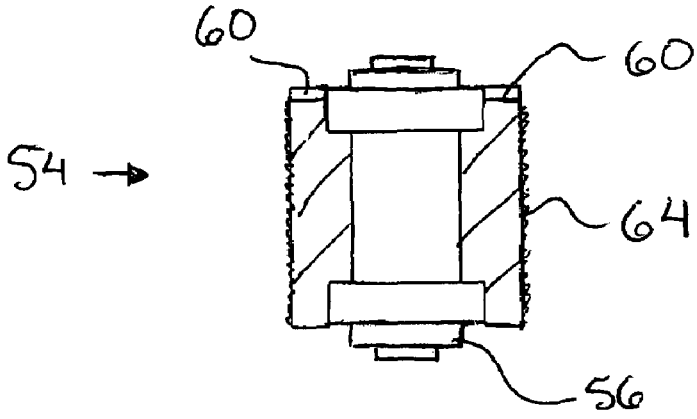
FIG. 6 is a partly sections plan view of one of the counting wheels.
Figure 7:
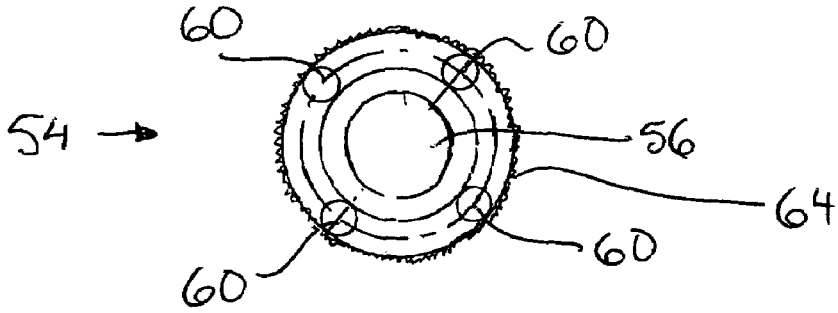
FIG. 7 is an end view of one of the counting wheels.

Referring to the accompanying Figures there is illustrated a coiled tubing counter generally indicated by reference numeral 10. The counter 10 is particularly suited for oil or gas well operations involving coiled tubing 12 for counting the depth which the tubing is inserted into the well.

The counter 10 is typically used in an oil or gas well having an outer casing 14 terminating at a top end by a casing flange 16 which may connect a master valve 18, a flow tee 20 having an auxiliary valve 22 and a primary well control 24 which includes a stripper 25 and a blow out preventer (BOP) as components of the wellhead. A coiled tubing injector head 30 is connected above the primary well control 24. All of the wellhead components below the injector head, including the primary well control 24 are sealed with respect to the outer casing in such a manner so as to permit the components between the primary well control 24 and the outer casing to be pressurized.

Referring initially to FIGS. 1 through 7, a first embodiment of the counter 10 is illustrated which is particularly suited for pressurized connection below the injector head 30 of the well.

The counter 10 includes an outer housing 32 which generally comprises a cylindrical casing forming a hollow tube having an open passage therethrough between opposing first and second ends 34 of the housing. The housing 32 is a pressure rated casing for use in the oil and gas industry.

Each end of the outer housing is threaded externally between axially spaced annular grooves 36 at an outer periphery thereof. The grooves 36 are arranged for receiving an annular sealing member therein.

Pressure rated connectors 38 are connected at each end 34 of the outer housing in sealing engagement therewith. The connectors 38 each include an inner end 40 which is cylindrical and which is internally threaded for mating with the threads at the ends 34 of the outer housing. A body of the connector 38 tapers inwardly through a central portion before joining with the outer end 42 which comprises an externally threaded collar for connection in series with the components of the well head.

The outer ends of the illustrated embodiment are designated 4 inch NPT, however any suitable connection of any size including threaded connections, flange connections, bowen unions or hammer unions could be used. The internally threaded portion of the inner end 40 of the connectors also includes annular grooves 44 therein which align with the grooves in the outer housing 34 for accommodating the sealing members received therein.

An inner housing 46 is received within the outer housing 32 for housing the working components within the counter with minimal modification being required to the outer housing during assembly to maintain the pressure rating of the outer housing. Internal shoulders 52 are formed within each connector 38 for abutting opposing ends of the outer housing when the connectors 38 are fastened thereon.

The inner housing 46 generally comprises two U-shaped channel members 48, each having base portion 48A and two side wall portions 48B. The channel members 48 are mounted with the open sides confronting one another and the free ends of the side wall portions 48B being abutted with those of the opposing channel so that the resulting assembled inner housing 46 is rectangular in cross section and elongate in the longitudinal direction of the outer housing. A mounting flange 48C is provided along each free end of the side wall portions which is oriented perpendicular to the respective side wall portion so as to lie flat and parallel in abutment with the mounting flange of the opposing channel when mounting the channels together to assemble the inner housing. Suitable fasteners can be used to fasten the mounting flanges 48C together.

The inner housing has open ends for receiving the tubing therethrough. Also, the inner housing is near in length to the outer housing for being retained between the connectors at opposing ends of the outer housing. A pair of mounting plates 50 are provided at opposing ends of the inner housing 46 for supporting the inner housing within the outer housing. Each mounting plate 50 is circular and spans the interior diameter of the outer housing. A central opening in each plate 50 is suitably shaped for receiving the abutted channel members 48 therethrough. The mounting plates 50 thus span radially between the inner housing and the outer housing about a full circumference at spaced apart locations at opposing ends of the housings to support the inner housing within the outer housing.

Each mounting plate 50 is divided into two halves corresponding to the two channel members forming the inner housing so that the two halves of each mounting plate can be separated when the channel members are separated for ease of access to internal components of the inner housing.

The inner housing supports a set of four counting wheels 54 therein. Each wheel is supported for rotation by bearings on a respective shaft 56 which spans between opposing side plates of a carriage 58 supporting the wheel thereon. Each carriage 58 extends inwardly from a respective base portion of one of the channel members 48 and is supported for movement in a horizontal direction which is perpendicular to the longitudinal direction between ends of the housing so that the counting wheels 54 are permitted to be displaced towards and away from the coiled tubing which extends longitudinally through the housing. A set of four springs 59 in a rectangular configuration support each carriage 58 on the respective channel member for biasing the counting wheels inwardly towards the coiled tubing and towards opposing counting wheels.

The counting wheels 54 are mounted within the inner housing in two pairs which engage opposing side of the coiled tubing and accordingly the two pairs of wheels define a channel or through passage extending therebetween through which the tubing is received. The pairs of wheels are longitudinally staggered so that one wheel of each pair is longitudinally centered between the opposing pair of wheels. The springs 59 support the wheels to be biased inwardly towards the opposing pair of wheels.

Each wheel includes a set of four markers 60, in the form of magnets, supported at equally circumferentially spaced positions about the wheel. A corresponding sensor 62 is supported on the internal housing for alignment with the markers 60 of each wheel as the wheel is rotated. The sensor 62 detects each time the magnet passes as the wheel is rotated. The radius of the magnet and sensor from the shaft 56 is arranged to correspond to an even unit of measure for each complete rotation of the wheel.

An outer surface 64 about the periphery of each wheel 54 is generally flat and cylindrical in shape so as to have a substantially constant outer diameter. The surface 64 has a knurled gripping texture for gripping the tubing to ensure that the wheels rotate and ride along the tubing as the tubing is displaced longitudinally through the housings. The flat outer surface 64 ensures that a portion of the circumference of the coiled tubing is engaged with the tubing at all times as the wheel rides along the side of the tubing extending through the housing regardless of the size and shape of the tubing.

A funnel member 66 is provided at both top and bottom ends of the outer housing to guide the coiled tubing therethrough. Each of the funnel members 66 tapers inwardly and downwardly from top to bottom in the direction which the tubing is first inserted through the housing.

At the top end of the housing, the funnel member 66 comprises a sleeve supported within the outer end of the connector 38. The sleeve includes a tapered shoulder 67A which slopes downwardly and inwardly towards a central opening 67B of reduced diameter. A bushing 67C is supported within the central opening which has an upper end face which is similarly sloped downwardly and inwardly so as to be continuous in profile with the tapered shoulder 67A of the funnel member. A central opening in the bushing receives the tubing therethrough.

At the bottom end of the housing, the funnel member 66 comprises a bushing 68A which is elongate and cylindrical. A top end face 68B at an inner end of the bushing 68A is sloped downwardly and inwardly so as to be continuous in profile with the inner surface 68C of the body of the connector 38 extending between the inner and outer collars of the lower connector.

A downwardly and outwardly facing shoulder is formed about the bushing 68A for engaging a split retainer ring 69 which retains the bushing 68A in position within the outer end of the lower connector 38. The ring 69 is received within a mating annular groove within the internal surface of the lower connector 38.

A split retainer ring 69 is also received within a mating annular groove in the sleeve forming the upper funnel member 66 to retain the bushing 67C axially in position.

The bushings 68A and 67C comprise guide collars formed of a material having a low coefficient of friction, for example neoprene, Teflon or nylon, and have an internal diameter which is only slightly greater than the coiled tubing for receiving the tubing therethrough with minimal frictional resistance. Both of the bushings are aligned axially with one another in the longitudinal direction and with the longitudinal channel or through passage defined between the opposing pairs of rollers.

Each of the sensors 62 communicates with a computer controller 70 externally of the housing through a pressure port 72A provided through a side wall of the outer housing. The pressure port 72A comprises a bore formed in the outer housing which receives a pre-manufactured, internally threaded sleeve which is welded in place within the bore. The sleeve is pressure rated. One such example of a sleeve is available under the trade name Thread-a-let.

A commercially available and pressure rated plug 72B, having external threads, is mounted within the sleeve defining the pressure port 72A in sealing engagement therewith. The plug includes electrical connections 74 extending therethrough and in communication betweens the sensors 62 and the controller 70. Annular grooves 72C are formed in the internal surface of the plug 72B for receiving epoxy which seals between the electrical connections and the plug.

The controller 70 records the signals from the sensors 62 which detect each time a magnet is rotated past it. The controller maintains a log of the total revolutions for each wheel and compares the tally or count of the revolutions of the wheels to one another. Whenever one of the wheels differs from the majority, a flag is marked on the log to indicate an error, for example due to slippage of one of the wheels 54. The controller averages the number of revolutions counted by each wheel unless the number of revolutions of one of the wheels differs substantially from the remaining wheels. In this instance, the controller only averages the number of revolutions of wheels which are near in magnitude to one another to produce very accurate counts.

Figure 8:
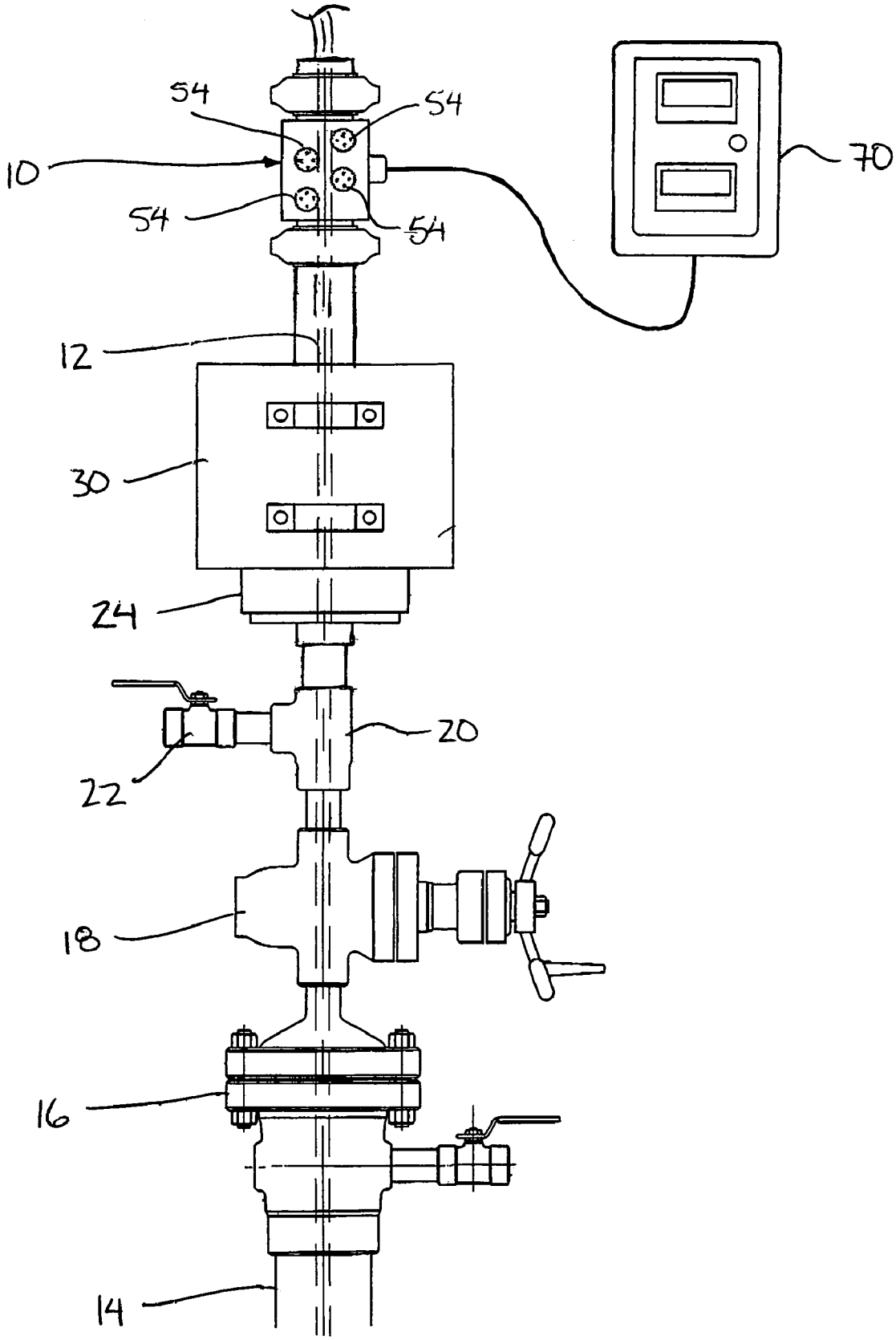
FIG. 8 is a side elevational view of the counter installed above the injector head of the wellhead.

In a further embodiment shown in FIG. 8, the counter 10 may instead be mounted above the injector head 30. In this instance, the outer housing and connectors are not required to be pressure rated or sealably engageable with the components of the well. All of the details with regard to the mounting and configuration of the counting wheels in the second embodiment remain substantially identical to the first embodiment noted above for similarly determining when slippage errors have occurred by comparing numbers of rotations of the plurality of counting wheels. When mounting above the injector head 30, the counter does not take into account the stretch of the tubing below the injector head, but the increased counting accuracy due to multiple counting wheels being provided remains an advantage regardless of the placement of the counter 10.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A tubing counter in combination with a well having an outer casing and a coiled tubing injector head connected above the outer casing and arranged to insert coiled tubing into the well, the tubing counter being arranged for counting coiled tubing inserted into the well and comprising:

an outer housing comprising a counter casing which is arranged to be pressurized and which has a through passage extending between ends of the housing such that the outer housing is arranged to receive the coiled tubing therethrough;

the outer housing being connected in series between the coiled tubing injector head and the outer casing of the well;

pressure rated connectors connected at both of the ends of the outer housing and connecting the outer housing in between the coiled tubing injector head and the outer casing of the well in sealing engagement therewith;

at least one counting wheel rotatably supported within the outer housing and arranged to be in rolling engagement along coiled tubing inserted through the outer housing; and a counting mechanism arranged to record a number of rotations of said at least one counting wheel.

2. The counter according to claim 1 wherein the well includes a primary well control sealed with respect to the outer casing so as to be arranged to be pressurized and the pressure rated connectors are arranged to connect the outer housing in sealing engagement below the primary well control of the well.

3. The counter according to claim 1 wherein said at least one counting wheel comprises a plurality of counting wheels and wherein the counting mechanism is arranged to record a number of rotations of each wheel independently of the other wheels.

4. The counter according to claim 1 wherein the counting mechanism includes a plurality of markers spaced circumferentially about each wheel and a sensor associated with each wheel which is arranged to sense and record rotation of the markers past the sensor.

5. The counter according to claim 1 wherein each wheel has a generally cylindrical outer surface arranged for engaging the tubing, the outer surface having a substantially constant outer diameter.

6. The counter according to claim 5 wherein the outer surface includes a gripping texture thereon.

7. The counter according to claim 1 wherein there is provided an upper funnel structure at one end of the outer housing and a lower funnel structure at the other end of the housing, the upper and lower funnel structures being arranged for guiding the tubing into and out of the outer housing respectively, each funnel structure including an annular bushing arranged for slidably receiving the tubing therethrough.

8. The counter according to claim 1 wherein said at least one counting wheel comprises a plurality of counting wheels supported on opposing sides of the through passage and arranged for engaging opposing sides of tubing inserted through the housing, at least one counting wheel on one side of the through passage being biased towards at least one counting wheel on the other side of the through passage.

9. The counter according to claim 1 wherein the outer housing is pressure rated and wherein there is provided an inner housing rotatably supporting said at least one counting wheel thereon, the inner housing being selectively supported within the outer housing by support members spanning generally radially between the inner housing and the outer housing at opposed ends of the outer housing.

10. A tubing counter in combination with a well having an outer casing and a coiled tubing injector head connected above the outer casing and arranged to insert coiled tubing into the well, the tubing counter being arranged for counting coiled tubing inserted into the well and comprising:

an outer housing comprising a casing which is arranged to be pressurized and which has a through passage extending between ends of the housing such that the outer housing is arranged to receive the coiled tubing therethrough;

the outer housing being connected in series between the coiled tubing injector head and the outer casing of the well;

pressure rated connectors connected at both of the ends of the outer housing arranged to connect the outer housing in between the coiled tubing injector head and the outer casing of the well in sealing engagement therewith:

at least one counting wheel rotatably supported within the outer housing and arranged to be in rolling engagement along coiled tubing inserted through the outer housing;

a controller arranged to record a number of rotations of said at least one counting wheel;

a pressure rated port formed in the outer housing;

electrical connections communicating through the pressure rated port between said at least one counting wheel and the controller; and a sealing material surrounding the electrical connections extending through the pressure rated port so as to be arranged to seal the electrical connections in the pressure rated port.

11. A tubing counter arranged for counting coiled tubing inserted into a well having an outer casing and a coiled tubing injector head connected above the outer casing, the counter comprising:

an outer housing having a through passage extending between ends of the housing arranged to receive coiled tubing therethrough;

connectors on the outer housing arranged to connect the outer housing in series with the coiled tubing injector head;

a plurality of counting wheels rotatably supported within the outer housing and arranged for rolling engagement along coiled tubing inserted through the outer housing; and a counting mechanism arranged to independently record a number of rotations of each counting wheel independently of the other wheels as tubing is inserted into the well;

the counting mechanism being arranged to determine an average number of rotations using said number of rotations of each counting wheel.

12. The counter according to claim 11 wherein the counting mechanism includes a plurality of markers spaced circumferentially about each wheel and a sensor associated with each wheel which is arranged to sense and record rotation of the markers past the sensor.

13. The counter according to claim 11 wherein each wheel has a generally cylindrical outer surface arranged for engaging the tubing, the outer surface having a substantially constant outer diameter and a gripping texture thereon.

14. The counter according to claim 11 wherein the counting mechanism is arranged to remove from the average the number of rotations of any wheel which differs substantially from the other wheels.

15. The counter according to claim 11 wherein the plurality of counting wheels are supported on opposing sides of the through passage so as to be arranged for engaging opposing sides of the tubing, at least one counting wheel on one side of the through passage being biased towards at least one counting wheel on the other side of the through passage.

16. A method of counting coiled tubing inserted into a well having an outer casing, a primary well control including a blow out preventer and sealed with respect to the outer casing, and a coiled tubing injector head connected above the primary well control including the blow out preventer, the method comprising:

providing a tubing counter comprising an outer housing having a through passage extending between ends of the housing which is arranged to be pressurized and at least one counting wheel rotatably supported within the outer housing;

connecting the ends of the outer housing of the counter in series between the primary well control and the outer casing of the well such that the outer housing is connected below the primary well control including the blow out preventer and the primary well control is sealed with respect to the outer casing of the well;

inserting the coiled tubing through the outer housing of the counter in rolling contact with said at least one counting wheel; and counting a number of rotations of said at least one counting wheel.

17. The method according to claim 16 wherein the primary well control includes a tubing stripper and the method includes connecting the outer housing below the tubing stripper of the primary well control of the well.

18. The method according to claim 16 wherein said at least one counting wheel comprises a plurality of counting wheels and wherein the method includes counting a number of rotations of each wheel independently of the other wheels and calculating an average number of rotations of the wheels.

19. The method according to claim 18 including comparing the number of rotations of the wheels to one another and removing from the average the number of rotations of any wheel which differs substantially from the other wheels.

* * * * *